US009976809B2

(12) United States Patent
Pingale et al.

(10) Patent No.: US 9,976,809 B2
(45) Date of Patent: May 22, 2018

(54) CONDENSATE AND FLASH STEAM RECOVERY SYSTEM

(71) Applicant: FORBES MARSHALL PVT. LTD, Maharashtra (IN)

(72) Inventors: Milind Pingale, Maharashtra (IN); Ronnie Joseph, Maharashtra (IN)

(73) Assignee: FORBES MARSHALL PRIVATE LTD., Maharashtra (IN)

( * ) Notice: Subject to any disclaimer, the term of this patent is extended or adjusted under 35 U.S.C. 154(b) by 222 days.

(21) Appl. No.: 14/895,874

(22) PCT Filed: Jun. 3, 2014

(86) PCT No.: PCT/IN2014/000378
§ 371 (c)(1),
(2) Date: Dec. 3, 2015

(87) PCT Pub. No.: WO2014/199396
PCT Pub. Date: Dec. 18, 2014

(65) Prior Publication Data

US 2016/0123672 A1 May 5, 2016

(30) Foreign Application Priority Data

Jun. 4, 2013 (IN) ..... 1945/MUM/2013

(51) Int. Cl.
*B01D 19/00* (2006.01)
*F28B 9/08* (2006.01)
*F28B 9/10* (2006.01)

(52) U.S. Cl.
CPC . *F28B 9/08* (2013.01); *F28B 9/10* (2013.01)

(58) Field of Classification Search
CPC ..... Y10T 137/3009; Y10T 137/309; Y10T 137/3096; F28B 9/08; F28B 9/10
USPC ..... 62/150, 272; 237/9 R, 67, 68
See application file for complete search history.

(56) References Cited

U.S. PATENT DOCUMENTS 2,515,650 A * 7/1950 Hunt ..... F24D 1/00 122/442
3,572,588 A 3/1971 Hamilton, Jr.
3,823,222 A * 7/1974 Benson ..... B01D 51/10 423/223

(Continued)

FOREIGN PATENT DOCUMENTS

CN 201715878 U 1/2011
CN 202902258 U 4/2013

OTHER PUBLICATIONS

International Search Report issued in connection with PCT/IN2014/000378 dated Jan. 16, 2015 (2 pages).

*Primary Examiner* — Jessica Cahill
(74) *Attorney, Agent, or Firm* — Robert P. Michal, Esq.; Carter, DeLuca, Farrell & Schmidt, LLP

(57) ABSTRACT

A system for recovering flash steam and condensate includes a flash steam recovery unit for recovering steam from a fluid containing flash steam and condensate, a condensate recovery unit positioned below the flash steam recovery unit to receive the condensate by gravity, wherein the condensate recovery unit is operated by pressurized pumping means which are adapted for selectively receiving the condensate into the condensate recovery unit, discharging the condensate to a process equipment through an outlet steam trapping unit, and discharging the exhaust gas via an exhaust gas outlet.

9 Claims, 7 Drawing Sheets

(56) References Cited

U.S. PATENT DOCUMENTS

| | | | | |
|---|---|---|---|---|
| 3,885,621 | A * | 5/1975 | Slebodnick | F22D 1/32 122/32 |
| 4,239,603 | A * | 12/1980 | Egosi | B01D 1/2881 122/40 |
| 4,249,486 | A * | 2/1981 | Potochnik | F22D 11/00 122/412 |
| 4,370,949 | A * | 2/1983 | Beckett | F22B 33/00 122/20 B |
| 6,279,593 | B1 * | 8/2001 | Sheppard | F16T 1/00 137/1 |
| 7,017,528 | B2 * | 3/2006 | Kumamoto | B01J 19/0013 122/15.1 |
| 8,961,708 | B2 * | 2/2015 | Kaiser | B08B 9/032 134/166 C |
| 2006/0236865 | A1 * | 10/2006 | Jellema | B01D 5/0027 95/149 |
| 2009/0320478 | A1 * | 12/2009 | Head | F04F 5/16 60/657 |
| 2011/0214623 | A1 | 9/2011 | Choi et al. | |

* cited by examiner

CONDENSATE AND FLASH STEAM RECOVERY SYSTEM

CROSS-REFERENCE TO RELATED APPLICATIONS

This application is a National Phase Entry under 35 USC § 371 of PCT Patent Application Serial No. PCT/IN2014/000378 filed Jun. 3, 2014, which claims the benefit under 35 USC § 119(e) to Indian Patent Application No. 1945/MUM/2013, filed Jun. 4, 2013, the disclosure of each of these applications are expressly incorporated herein by reference in their entireties.

FIELD OF THE DISCLOSURE

The present disclosure relates to a condensate and flash steam recovery system.

BACKGROUND

Steam is commonly used in most process plants for providing heating/evaporation. The steam once used loses its latent heat and is converted into a condensate. The condensate thus formed, in a single application or multiple such applications at different locations, is pumped, typically at atmospheric pressure, to a feed water tank in a boiler house, a condensate recovery header or any other suitable equipment. The recovery of the condensate is essential to optimize the overall efficiency as well as to reduce the operational cost of the plant.

Saturated condensate at higher pressure flashes into steam typically known as flash steam when it is exposed to a lower pressure. The amount of flash steam generated increases with the increase in the differential pressure across the process traps. The reduced pressure of the condensate downstream of the process trap is insufficient to return the condensate, on its own, back to the feed water tank, and hence the requirement of a pump arises to pump this condensate back.

Most of the condensate flashes at the beginning of the downstream line of the process trap and increases with the pressure drop of the downstream line. If this condensate and flash steam is directly routed to the condensate pump (the pump here refers to a positive displacement pressure operated pump or a condensate recovery unit) the flash steam will get entrapped with the condensate and flow into the pump. In most practical cases the condensate loses its heat to the atmosphere as losses through the downstream line, and usually gets sub-cooled. This temperature difference causes the flash entrapped within the condensate to collapse leading to knocking or the phenomenon generally known as steam hammer.

Steam hammer within the pump causes vibrations due to high impact forces which can damage the internals of the pump, the return line to the feed water tank and can also cause structural damage to the pump shell and supports.

This problem inherently shows that the flash steam would have to be separated from the condensate before pumping. This separation of flash steam from the condensate is done by an appropriately sized vessel known as a flash vessel. The flash vessel separates the flash steam from the condensate, which can be used in any suitable application. The separated condensate then flows through a steam trap located at the condensate outlet (located typically at the bottom of the flash vessel), which ensures that flash steam cannot escape from the flash vessel through the condensate outlet to the pump receiver. The pump is usually located in a pit so that the condensate from the flash vessel trap can flow by gravity into the pump receiver or the flash vessel is raised to achieve the same.

The pressure at which the flash vessel is operated depends upon the applications in which the flash steam is utilized. However in most cases, wherever the flash is utilized in a suitable application, the flash vessel pressure is maintained above the atmospheric pressure. In applications where there are no suitable uses of flash steam or there is no practical feasibility of usage, the flash steam is vented to the atmosphere due to which the flash vessel is operated at atmospheric pressure.

The known systems for condensate and flash steam recovery exhibit several drawbacks. In these systems, if the steam trap fails to operate downstream of the flash vessel, in the closed condition, the flash vessel floods leading to steam hammer as the condensate level increases beyond the flash vessel inlet. This may also lead to a condition where the condensate backs up to the process, thereby affecting the associated process heating equipment, especially in situations where the condensate load is substantial.

When the steam trap fails in the open condition there is a possibility of flash steam escaping through the condensate outlet which is then vented to the atmosphere through the liquid dispenser. Also, the large number of joints and complex design of the existing condensate recovery systems increase the chances of leakage and thereby losses. It also leads to a larger footprint area and hence occupies more floor space.

Thus, there is felt a need for a system which reduces the above-listed drawbacks.

OBJECTS

Some of the objects of the system of the present disclosure, which at least one embodiment herein satisfies, are as follows:

An object of the present disclosure is to provide a condensate and flash steam recovery system which recovers the energy of the condensate by avoiding losses due to secondary flashing.

Another object of the present disclosure is to provide a condensate and flash steam recovery system which enables recovery of the motive steam.

Yet another object of the present disclosure is to provide a condensate and flash steam recovery system in which the liquid dispensers are installed above the ground level.

Still another object of the present disclosure is to provide a condensate and flash steam recovery system which has a simple and compact construction, is easy to maintain and access, and safe to use.

One more object of the present disclosure is to provide a condensate and flash steam recovery system which prevents steam hammer in the line.

An additional object of the present disclosure is to provide a system which improves the overall efficiency by energy recovery from the condensate.

One more object of the present disclosure is to provide a level based system which monitors and diagnoses the health of the condensate and flash steam recovery system.

Yet another object of the present disclosure is to provide a backup mechanism in case the existing condensate pumping mechanism fails.

A still further object of the present disclosure is to provide a pH correction of the condensate by means of pressure operated mechanism.

Other objects and advantages of the present disclosure will be more apparent from the following description when read in conjunction with the accompanying figures, which are not intended to limit the scope of the present disclosure.

SUMMARY

In accordance with the present disclosure, there is provided a system for recovering flash steam and condensate, said system comprising:

a flash steam recovery unit adapted for receiving a fluid containing flash steam and condensate through an inlet provided at the operative side of said flash steam recovery unit, said flash steam recovery unit further adapted for recovering flash steam from the condensate via a steam outlet provided at the operative top of said flash steam recovery unit; and a condensate recovery unit positioned at the operative bottom of said flash steam recovery unit and having an orientation for receiving the condensate by gravity from said flash steam recovery unit through a condensate inlet, said condensate recovery unit being operated by pressurized pumping means adapted for discharging the condensate through an outlet steam trapping unit operatively connected to a condensate outlet provided at the operative side of said condensate recovery unit, and discharging exhaust gas via an exhaust gas outlet provided at the operative top of said condensate recovery unit.

The pressurized pumping means further comprises a plurality of check valves for controlling the operation of said condensate recovery unit by means of a pressurized gas, wherein, in operation, when the condensate level in said condensate recovery unit reaches beyond a set level, the pressurized gas increases the pressure in said condensate recovery unit and said pressurized pumping means to open at least one of said plurality of valves at said condensate outlet, thereby discharging the condensate through said steam trapping unit while maintaining at least one of said plurality of valves at said condensate inlet closed, and when the condensate level in said condensate recovery unit reaches below a set level, pressurized exhaust gas is released via said exhaust gas outlet, thereby opening at least one of said plurality of valves at said condensate inlet to receive the condensate from said flash steam recovery unit in said condensate recovery unit while maintaining at least one of said plurality of valves at said condensate outlet closed.

The pressurized gas can be pressurized steam.

An exhaust line is provided for operatively connecting said exhaust gas outlet to a location proximal to the operative top of said flash steam recovery unit for conveying pressurized exhaust steam to said flash steam recovery unit.

The flash steam recovery unit can further comprise an overflow trap located at said operative side of said flash steam recovery unit below said inlet for avoiding flooding of said flash steam recovery unit and maintaining a defined vapor space.

Additionally, in accordance with the present disclosure, a level indicator or a level-based means is provided to monitor the level of the fluid in said flash steam recovery unit and diagnose the health of said system.

Alternatively, in accordance with the present disclosure, an additional condensate recovery unit is operatively connected to said flash steam recovery unit for preventing build-up of the fluid in said steam recovery unit due to failure of condensate recovery unit. Preferably, said additional condensate recovery unit is operated by mechanical or level controlled means.

Additionally, in accordance with the present disclosure, a pH correction means operated by a pressure-driven mechanism is provided for correcting the pH of said condensate.

BRIEF DESCRIPTION OF THE ACCOMPANYING DRAWINGS

The condensate and flash steam recovery system of the present disclosure will now be described with the help of accompanying drawings, in which.

DETAILED DESCRIPTION

A system and a method of the present disclosure will now be described with reference to the embodiments which do not limit the scope and ambit of the disclosure.

The embodiments herein and the various features and advantageous details thereof are explained with reference to the non-limiting embodiments in the following description. Descriptions of well-known components and processing techniques are omitted so as to not unnecessarily obscure the embodiments herein. The examples used herein are intended merely to facilitate an understanding of ways in which the embodiments herein may be practiced and to further enable those of skill in the art to practice the embodiments herein. Accordingly, the examples should not be construed as limiting the scope of the embodiments herein.

The known systems for flash steam and condensate recovery include a flash vessel (vessel sized to separate the flash steam from the condensate at a set pressure, also known as a vertical knock out drum) and a liquid dispenser operated by a suitable pressurized gas (float operated mechanism or level based system) to pump the condensate back to the feed water tank, the condensate header or any other suitable equipment. The liquid dispenser in most cases is provided with a receiver to take into account the cyclic operation of exhaust, filling and pumping.

The condensate from most process heating equipment's, such as heat exchangers, evaporators, etc., is at a pressure higher than the atmospheric pressure and is recovered through a steam trap. The steam trap enables draining of the condensate while preventing escape of steam from the equipment. In order to ensure optimum trapping of the condensate, the pressure downstream of the steam trap is maintained at a level below the pressure within the equipment. The condensate flashes at the lower pressure downstream of the steam trap, becoming flash steam. The amount of flash steam produced depends on the upstream and downstream pressures. The flash steam is a percentage of the condensate and has heat content that can be utilized; thus, recovery of the flash steam further aids in enhancing the overall efficiency of the system.

The amount of flash steam generated can be calculated using the following equation:

Flash percentage=[(Enthalpy of condensate per unit mass at higher pressure)−(Enthalpy of condensate per unit mass at lower pressure)]/[(Latent heat of steam per unit mass at lower pressure)

Figure 1:
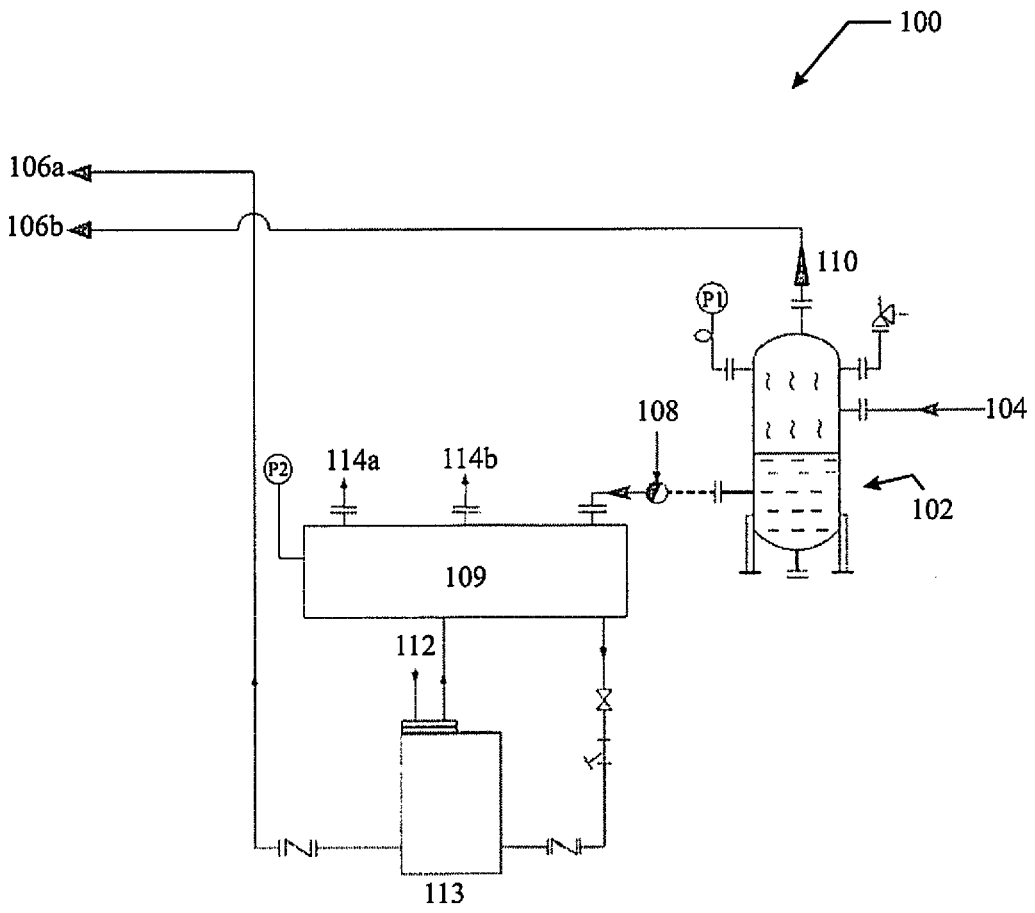
FIGURE 1 (Prior Art)
FIG. 1 (prior art) illustrates a schematic of a typical condensate and flash steam recovery system in which the flash vessel is maintained above atmospheric pressure and the pump is open to atmosphere.

A first illustration of the prior known systems is shown in the FIG. 1 of the accompanying drawings, in which, the system 100 includes a flash vessel 102 above atmospheric pressure and a liquid dispenser 109 open to the atmosphere. The condensate and the flash steam 104 from a process are drained into the flash vessel 102. The flash vessel 102 separates the condensate from the flash steam based on gravity separation, thus, draining the condensate from the bottom through a steam trap 108 while recovering the flash steam from a vent 110 provided at the operative top of the vessel 102. The flash steam is received in the associated equipment through line 106.

The condensate from the trap 108 is then routed to the liquid dispenser 109 which in turn pumps the condensate by means of a pump 113 against a back pressure to the associated equipment, through line 106*a*, using a suitable motive gas, usually steam, received through an inlet 112.

The system 100 is plagued with several drawbacks. The flash vessel 102 is operated above atmospheric pressures leading to flashing of the condensate downstream of the steam trap 108. Some flash steam is vented out to the atmosphere through the liquid dispenser receiver (if provided) leading to direct flash steam wastage. This amount of flash steam generated at the steam trap 108 of the flash vessel is lesser by mass as compared to the mass of flash steam being recovered and hence it is easily vented from the vents provided on the pump receiver. If the liquid dispenser 109 does not have a receiver as the liquid dispenser is filled with condensate, the flash steam passes through it and collapses as it loses its latent heat to the sub-cooled condensate. This leads to steam hammer or cavitation in the liquid dispenser 109 and hence reducing its service life. In certain cases where the length of the line leading to the liquid dispenser is long, the flash steam collapses in the line itself leading to steam hammer therein. The motive gas, when steam is used, is vented to the atmosphere through the liquid dispenser exhaust 114*a* & 114*b* or receiver which is a direct wastage of live steam.

A typical example of the losses due to secondary flashing from the pump receiver is given below (refer FIG. 1):

$$\text{Percentage flash steam} = \frac{(h_1 - h_2)}{hfg} \quad (1)$$

$$\text{Mass of flash steam} = \frac{m*(h_1 - h_2)}{hfg} \quad (2)$$

where, $h_2$=Enthalpy of the condensate per unit mass at higher pressure, P1 (KJ/kg)

$h_1$=Enthalpy of the condensate per unit mass at lower pressure, P2 (KJ/kg)

hfg=Latent heat of vapourization per unit mass at lower pressure, P1 (KJ/kg)

m=mass flow rate of condensate at higher pressure (kg/hr)

Typical flash pressures and loss values based on the above formulae are listed in Table 1.

TABLE 1

| Sr. No. | Flash vessel pressure (P1) barg | Trap downstream pressure/ Receiver pressure (P2) barg | Approximate Percentage losses (%) |
|---|---|---|---|
| 1 | 0.5 | 0 | 2.18 |
| 2 | 1 | 0 | 3.84 |
| 3 | 2 | 0 | 6.35 |
| 4 | 3 | 0 | 8.26 |
| 5 | 4 | 0 | 9.82 |

The percentage losses represent the direct loss of flash steam and thereby represent the loss of energy to the atmosphere from the system 100.

In an alternative scenario, where there is no possibility to recover and utilize flash steam, a more practical consideration is that the discharge of condensate from the trap connected to the flash vessel depends upon the difference in pressure between the flash vessel and the trap downstream pressure. Both pressures being at atmospheric make the discharge through the trap dependent upon the head of the condensate available in the flash vessel. The head available depends on the height above the pump at which the flash vessel is mounted which is typically 1.5 m to 2 m (1500 mm to 2000 mm).

To meet large condensate load requirements based on the heads available to the steam trap, a steam trap of a very large size would be required or the head on the trap would have to be increased either by elevating the flash vessel or by lowering the liquid dispenser. In most practical cases due to space constraints the differential head on the trap is too less to cater to the required process condensate load and leads to the flooding of the flash vessel.

As the head available to the trap is less, most liquid dispensers are installed below the flash vessels as in FIG. 1. In most cases liquid dispensers are installed in pits below the ground as a result of which maintenance and access is difficult during breakdowns.

The requirement of the flash vessel being mounted at a height above the pump increases the space required for the whole system making it bulky. Also, since the flash vessel and the pump have to be mounted separately it requires a larger footprint. The excess piping requirements from the flash vessel to the pump also makes it susceptible to leakage and losses.

In order to overcome the drawbacks of the known systems, the present disclosure envisages a novel system for recovering flash steam and condensate from a fluid containing flash steam and condensate. The recovered flash steam and the condensate may be reused in a further process equipment as boiler feed water, heating fluid, and the like.

Figure 2:
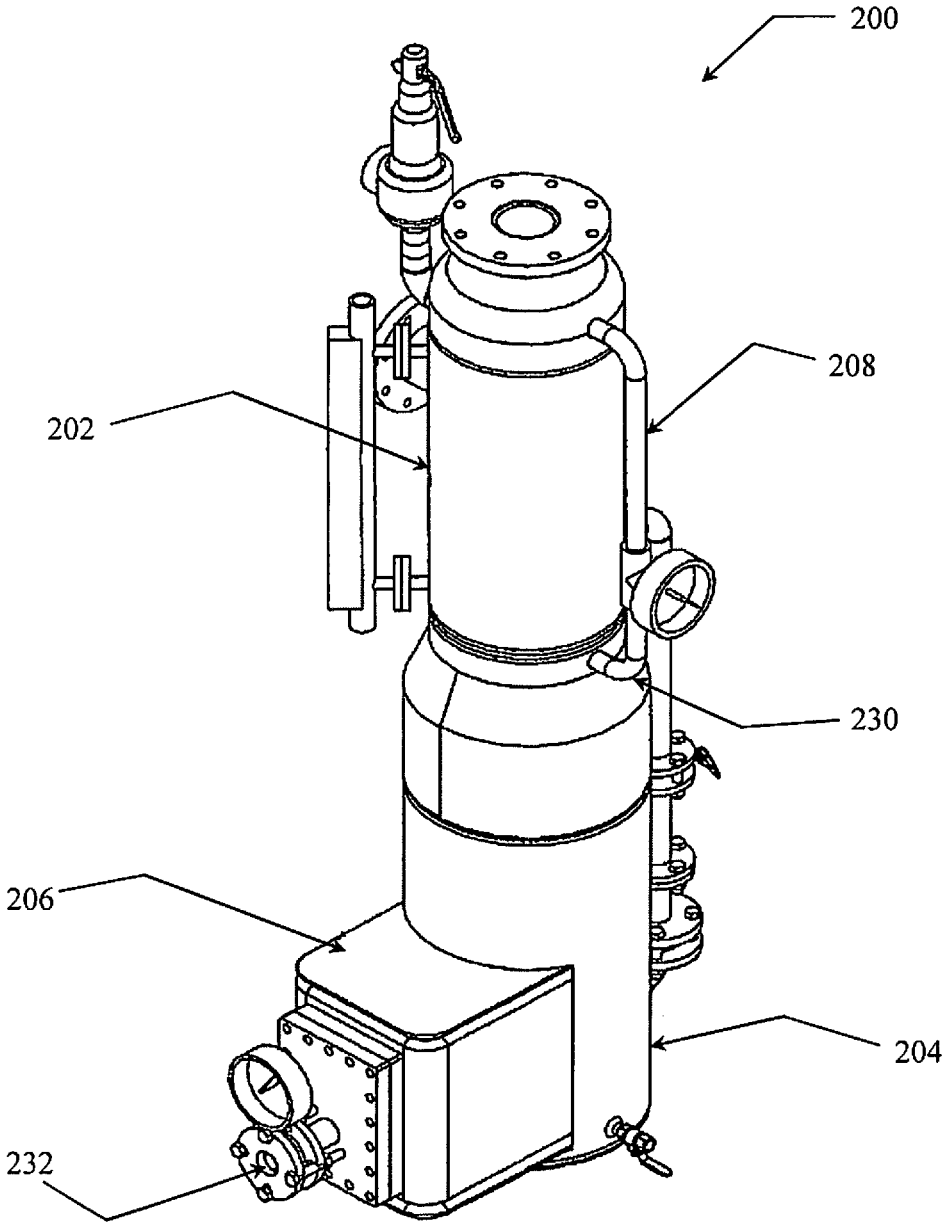
FIG. 2 illustrates a perspective view of a preferred embodiment of the condensate and flash steam recovery system in accordance with the present disclosure.

The system of the present disclosure seeks to achieve savings by operating the flash vessel and the pump at the desired flash pressure. This can be achieved by eliminating the pump receiver and the flash steam trap and replacing it with a flash steam recovery unit 202 (as shown in FIG. 2). A condensate recovery unit 204 (as shown in FIG. 2) and the flash steam recovery unit 202 are connected to each other by an exhaust line 208 (as shown in FIG. 2) that connects the steam exhaust of the condensate recovery unit 204 to the operative top of the flash steam recovery unit 202, next to the flash steam outlet. The condensate outlet 232 of the flash steam recovery unit 202 is connected to the inlet of the condensate recovery unit 204. This ensures that the condensate recovery unit 204 and the flash steam recovery unit 202 operate at the same pressure eliminating all chances of secondary flashing of the condensate while flowing into the condensate recovery unit 204. Additionally the exhaust steam from the condensate recovery unit 204 is also recovered through the flash steam outlet. Preventing secondary flashing ensures that the energy of the condensate is conserved compared to existing systems.

For typical flash pressures the energy savings by the system of the present disclosure compared to the existing systems is given below in Table 2.

TABLE 2

| Sr. No. | Flash vessel pressure (P1) barg | Approximate Percentage saving compared to existing systems (%) |
|---|---|---|
| 1 | 0.5 | 2.18 |
| 2 | 1 | 3.84 |
| 3 | 2 | 6.35 |
| 4 | 3 | 8.26 |
| 5 | 4 | 9.82 |

FIGS. 2, 3, 4 & 5 of the accompanying drawings illustrate a preferred embodiment of the system for recovering flash steam and condensate in accordance with the present disclosure, the system being generally referenced in the FIGS. by numeral 200. The system of the present disclosure enables recovery of energy from the fluid, the motive steam, and the condensate itself; it has a simple construction, is easy to maintain and access, and provides safe handling and high efficiency of the system.

Figure 3:
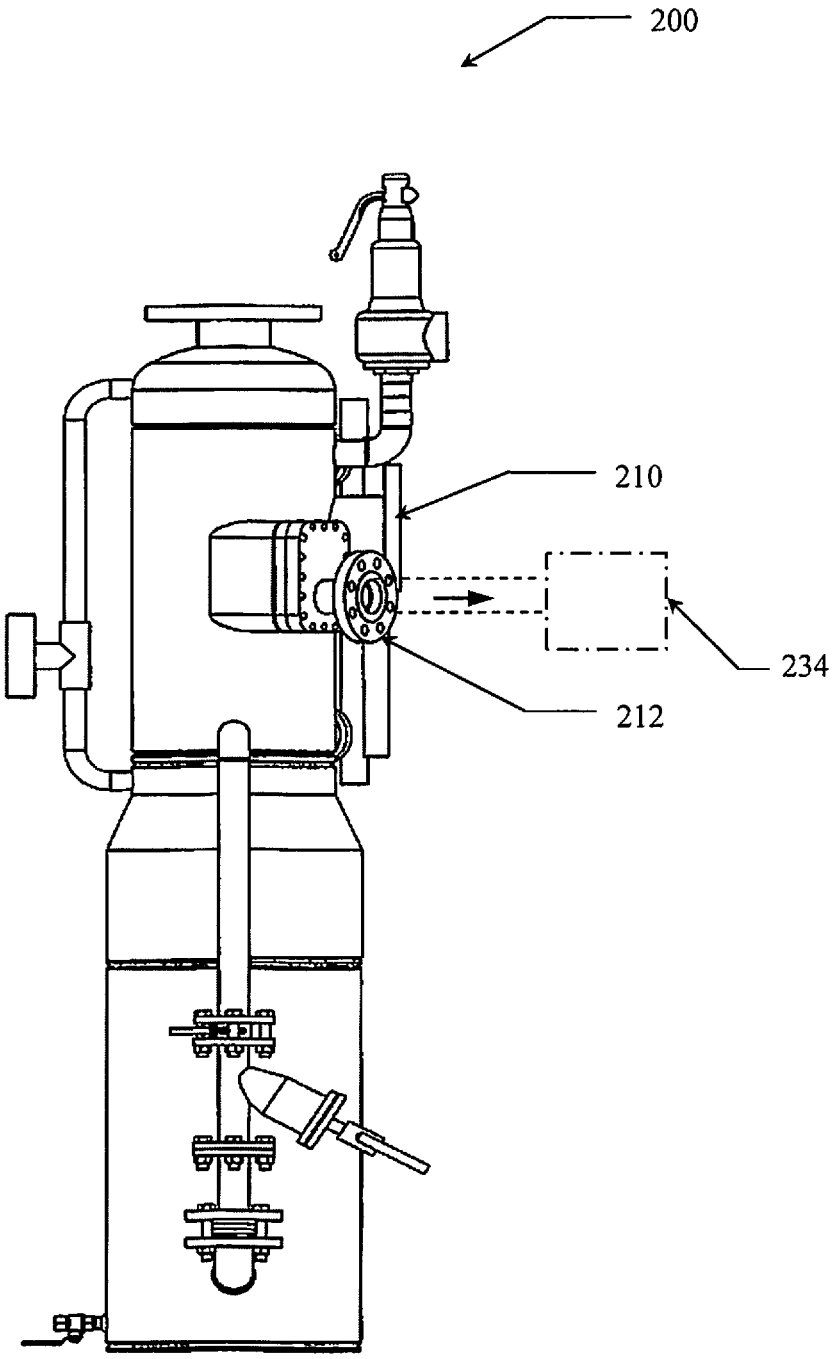
FIG. 3 illustrates a front view of the preferred embodiment of the condensate and flash steam recovery system shown in FIG. 2.
Figure 3A:
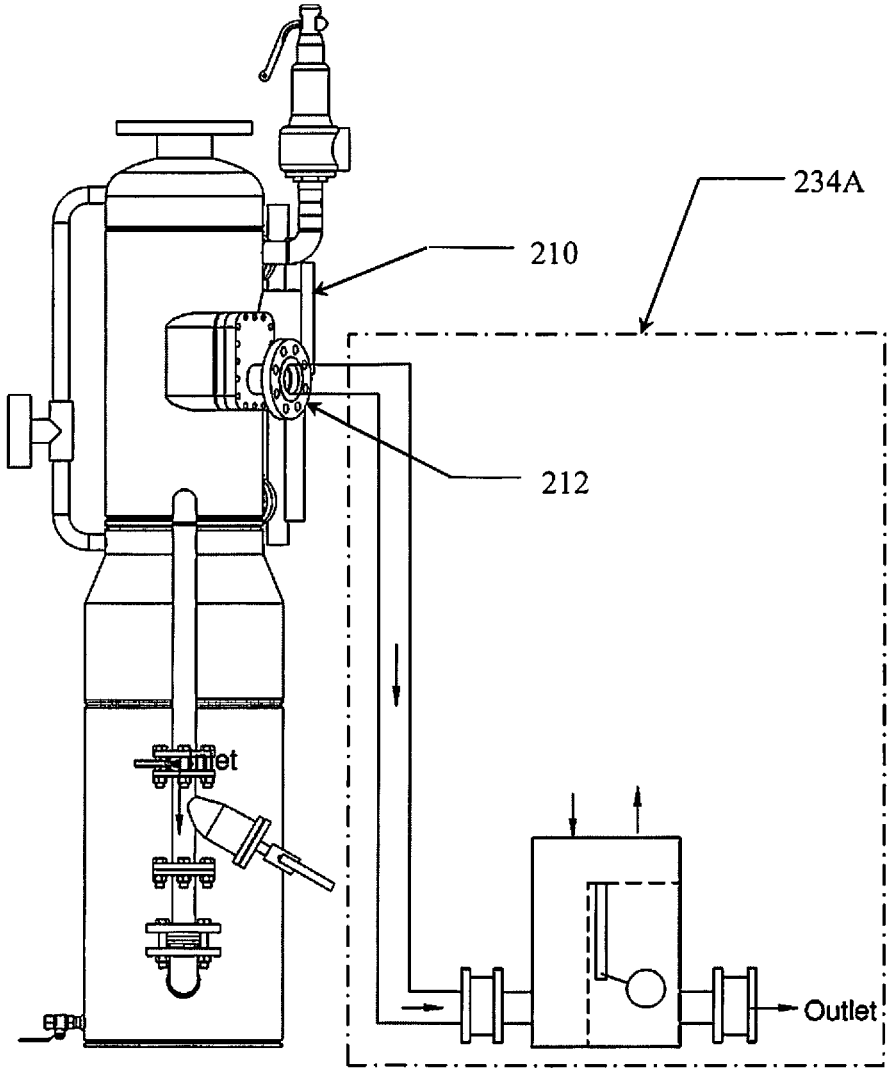
FIG. 3A illustrates a front view of a mechanical condensate recovery unit.
Figure 3B:
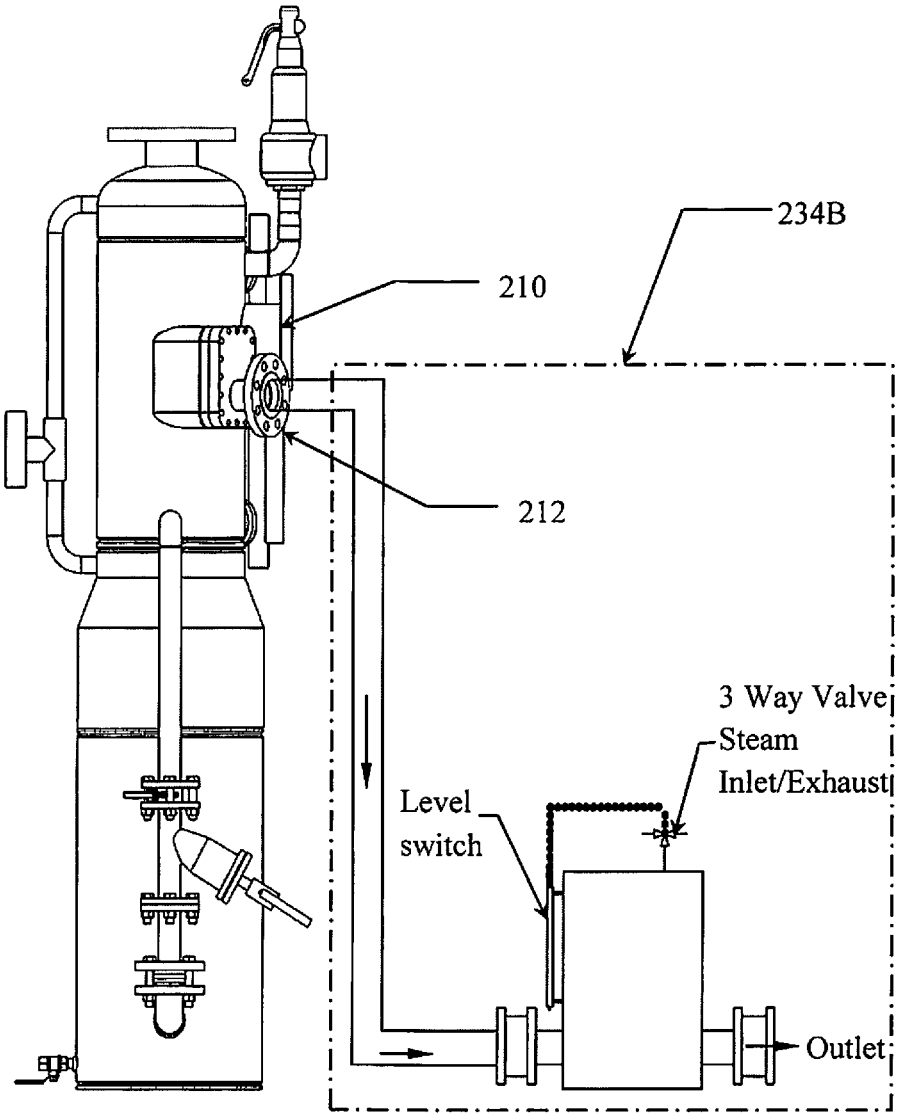
FIG. 3B illustrates a front view of a level based condensate recovery unit.
Figure 4:
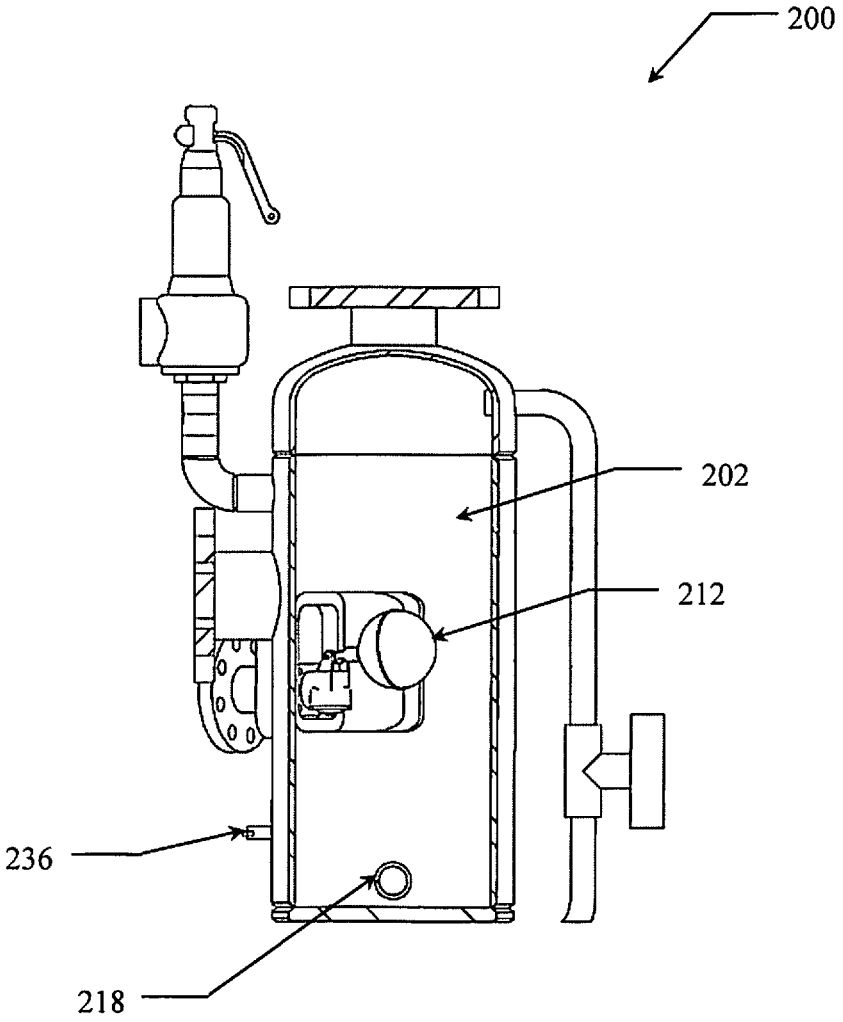
FIG. 4 illustrates a sectional view of the flash vessel of the preferred embodiment of the condensate and flash steam recovery system shown in FIG. 3.
Figure 5:
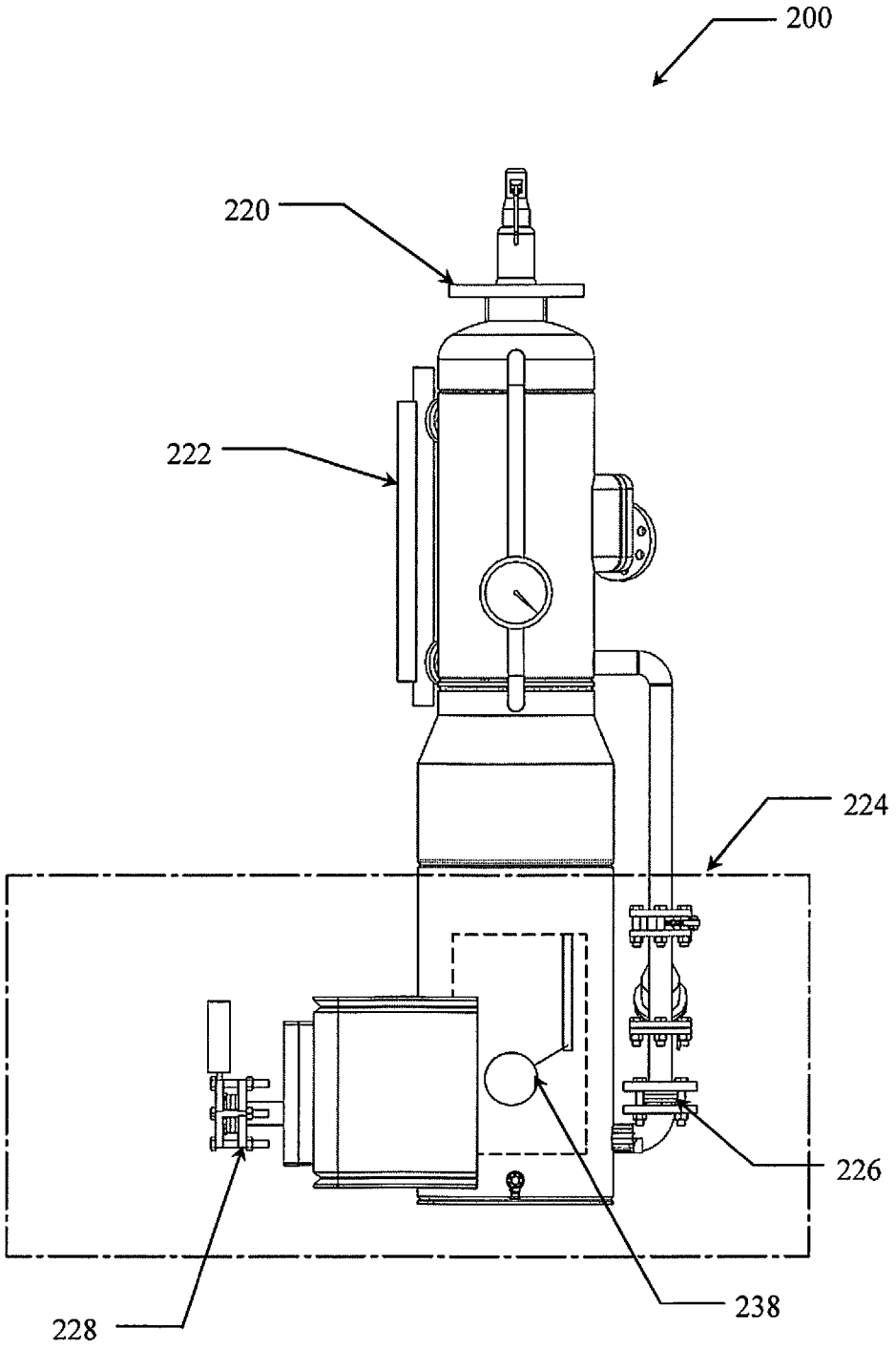
FIG. 5 illustrates a back-side view of the preferred embodiment of the condensate and flash steam recovery system shown in FIG. 2.

FIG. 2 shows a perspective view of the system 200 of the present disclosure. FIGS. 3 & 5 show the front view and the back-side view of the system 200, respectively. The system comprises the flash steam recovery unit 202 and the condensate recovery unit 204, where the condensate recovery unit 204 is positioned operatively below the flash steam recovery unit 202. FIG. 4 shows a sectional view of the flash steam recovery unit 202. The flash steam recovery unit 202 receives the fluid containing flash steam and condensate at an inlet 210. The inlet 210 is positioned at an operative side of the flash steam recovery unit 202. The flash steam recovery unit 202 includes a steam outlet 220 located at the operative top of the flash steam recovery unit 202 for discharging the recovered steam from the system 200. The inlet 210 and the steam outlet 220 are sufficiently spaced apart to allow a vapor space.

The flash steam recovery unit 202 is adapted to separate moisture from the flash steam, thereby recovering flash steam. The flash steam recovery unit 202 is a vertically tall vessel which separates the moisture from the steam by gravity settling method. The flash steam recovery unit 202 is thus adapted to act as a receiver for the condensate recovery unit 204 as well as the flash steam separator.

The condensate having a higher specific weight than steam settles at the bottom of the flash steam recovery unit 202, whereas flash steam being lighter moves upwards towards the top of the flash steam recovery unit 202. For a given flow rate and pressure, the velocity of flash steam is limited by the vessel diameter, thereby preventing the carryover of moisture along with the flash steam through the steam outlet 220. The vapor space generated by the gap between the inlet 210 and the steam outlet 220 provides the time required for the moisture carried with the flash steam to settle down in the flash steam recovery unit 202.

The flash steam recovery unit 202 includes an overflow trap 212 provided at the operative side of the flash steam recovery unit 202 at a location operatively below the inlet 210. The overflow trap 212 is adapted to maintain the vapor space and avoid flooding of the flash steam recovery unit 202 by draining the condensate to a drain, a back-up pump, and the like. This in turn ensures that flooding does not take place avoiding steam hammer in the steam recovery unit 202. A level indicator or any other level-based means 222 is provided to monitor the fluid levels in the flash steam recovery unit 202, thereby indicating the health of the system 200. An additional condensate recovery unit 234 is operatively connected to the flash steam recovery unit 202 for preventing build-up of the fluid in the flash steam recovery unit 202. The additional condensate recovery unit 234 can be operated by mechanical 234A or level controlled means 234B. A pH correction means 236 operated by a pressure-driven mechanism 238 is provided for correcting the pH of the condensate.

The condensate recovery unit 204 is oriented such as to receive the condensate by gravity from said flash steam recovery unit 202 through a condensate inlet 218. A condensate outlet 232 of the condensate recovery unit 204 is operatively connected to a steam trapping unit 206. The condensate outlet 232 is provided at the operative side of the condensate recovery unit 204. An exhaust gas outlet 230 is provided at the operative top of the condensate recovery unit 204. The condensate recovery unit 204 is selectively operated by pressurized pumping means 224.

The condensate recovery unit 204 is typically a float snap action type or a level based system. The condensate recovery unit 204 is operated by pumping means powered by a pressurized motive gas, preferably pressurized steam, generally known as a pressure powered pump. The pressurized pumping means 224 comprises a plurality of check valves for controlling the operation of the condensate recovery unit 204 by means of the pressurized gas/steam. The discharge from the pumping means depends on the back pressure against which it is required to pump, the pressure of the pressurized motive steam, the steam inlet size, the steam outlet size, the condensate inlet size, and the condensate outlet size. The condensate recovery unit 204 operates in three cycles, namely: exhaust, filling and pumping.

The pressurized pumping means 224 have at least two check valves—a first check valve 226 at the condensate inlet 218, and a second check valve 228 at the condensate outlet 232. During the filling cycle, the condensate flows into the condensate recovery unit 204 by gravity through the condensate inlet 218, while expelling air or steam through an exhaust valve at the exhaust gas outlet 230 provided at the operative top of the condensate recovery unit 204, until a predetermined condensate level is reached. Once the predetermined level is reached a mechanism or level switch is relayed to open the pressurized motive steam inlet line. At this time the back pressure is greater than the pump pressure which maintains the second check valve 228 in closed position.

Depending on the pressure of the motive gas, the condensate recovery unit 204 is pressurized to a pressure slightly greater than the back pressure in a given time-delay. When the pressure in the condensate recovery unit 204 increases over the back pressure, the second check valve 228 opens which enables pumping of the condensate into a condensate return line via the condensate outlet 232. Since, during pumping the pressure in the condensate recovery unit 204 is higher than the head required during filling, the first check valve 226 at the condensate inlet 218 is maintained in a closed position.

As the level of the condensate falls below a predetermined threshold, the exhaust valve at the exhaust gas outlet 230 is opened, thus discharging the pressurized steam, which thereby opens the first check valve 226 at the condensate inlet 218 and closes the second check valve 228 due to de-pressurization, thus initiating another filling cycle.

A high capacity steam trapping unit 206 may be integrated with the condensate recovery unit 204 to ensure that only condensate from the condensate outlet 232 is pumped into the condensate return line. Live steam (in cases of process traps leaking live steam) or flash steam is trapped by the steam trapping unit 206, thus preventing passage into the condensate return line. This helps in preventing steam hammer in the respective supply line. The steam trapping unit 206 has a predetermined orifice dimension size, considering the instantaneous capacities of the condensate recovery unit 204, to avoid additional pressure drop across the orifice of the steam trapping unit 206. Thus, preventing the additional pressure drop which hampers performance of the pumping means for a given motive and back pressure.

The exhaust gas outlet 230 at the operative top of the condensate recovery unit 204 is operatively connected to the flash steam recovery unit 202 through the exhaust line 208 at a location proximal to the operative top of the flash steam recovery unit 202 for conveying the pressurized exhaust steam to the flash steam recovery unit 202, thereby maintaining the flash steam recovery unit 202 and the condensate recovery unit 204 at the same pressure during the filling cycle. Thus, filling takes place because of the head available to the condensate recovery unit 204. This also prevents the condensate from flashing within the condensate recovery unit 204, thereby saving the energy equivalent to the amount that would have been flashed in the conventional systems. The exhaust being connected back to the flash steam recovery unit 202 ensures that the motive steam utilized in the previous pumping cycle is recovered along with the flash steam during the exhaust cycle.

The operation of the system is governed by two important factors, namely, flashing pressure and back pressure on the condensate recovery unit 204.

Under conditions where the flashing pressure is less than the back pressure, the condensate recovery unit 204 is in operation because the flash pressure is insufficient to open the second check valve 228 at the condensate outlet 232, thus leading to a rise of condensate level within the condensate recovery unit 204. The rise of condensate level causes the steam inlet valve to open causing the condensate recovery unit 204 to pump the condensate against the rated back pressure. After the pumping cycle, the excess pressure in the pump shell is relieved to the flash steam recovery unit 202 and is recovered from the steam outlet 220 in the flash steam recovery unit 202. Simultaneously, the first check valve 226 at the condensate inlet 218 opens due to de-pressurization, thus, allowing condensate to flow into the condensate recovery unit 204, and hence the cycle is reiterated.

During pumping, when the condensate continuously flows from the process heating equipment, the level of condensate in the flash steam recovery unit 202 is increased by an amount which depends on the condensate flow rate and the time involved in pumping the condensate against a back pressure. Thus, an additional volume is provided in the flash steam recovery unit 202, and the flow rates are restricted to an amount so as to avoid build-up of the condensate in the flash steam recovery unit 202.

In cases where the flashing pressure is greater than the back pressure, the second check valve 228 at the condensate outlet 232 opens due to a positive differential pressure. The second check valve 228 at the condensate outlet 232 opens as long as the condensate level in the condensate recovery unit 204 is adequate to open the steam trapping unit 206. The condensate is discharged through the orifice of the steam trapping unit 206 into the condensate return line. The amount of condensate that is discharged through the orifice depends upon the capacity of the steam trapping unit 206 at a given differential pressure at a given condensate level in the condensate recovery unit 204 as well as the rate of flow of the fluid into the system 200. The smaller of the two values at a given differential pressure across the trapping unit 206 is the governing factor.

Under this condition, the trapping unit 206 ensures that only condensate is discharged into the back pressure line, thus, trapping flash steam in cases where only flash steam is present in the system 200. The system includes a level switch/indicator which raises an alarm to a user regarding flooding in the flash drum, in case the pumping means fail to operate. The system further includes an alternative mechanism or level based system to operate in parallel during maintenance or breakdowns, thus, ensuring continuous operation.

TECHNICAL ADVANCEMENT

A system for recovering flash steam and condensate, as described in the present disclosure, has several technical advantages including, but not limited to, the realization of:

- recovery of energy from the condensate by avoiding losses due to secondary flashing;
- provides recovery of the motive steam;
- enables installation of the liquid dispenser above the ground level;
- has a simple and compact construction, is easy to maintain and access, and safe to use;
- prevents steam hammer in the line;
- improves the overall efficiency by energy recovery from the condensate;
- provides a level based system which monitors and diagnoses the health of the condensate and flash steam recovery system;
- provides a back-up mechanism in case the existing condensate pumping mechanism fails; and
- provides a pH correction of condensate by means of pressure operated mechanism.

Throughout this specification the word "comprise", or variations such as "comprises" or "comprising", will be understood to imply the inclusion of a stated element, integer or step, or group of elements, integers or steps, but not the exclusion of any other element, integer or step, or group of elements, integers or steps.

The use of the expression "at least" or "at least one" suggests the use of one or more elements or ingredients or quantities, as the use may be in the embodiment of the invention to achieve one or more of the desired objects or results.

Any discussion of documents, acts, materials, devices, articles or the like that has been included in this specification is solely for the purpose of providing a context for the invention. It is not to be taken as an admission that any or all of these matters form part of the prior art base or were common general knowledge in the field relevant to the invention as it existed anywhere before the priority date of this application.

The numerical values mentioned for the various physical parameters, dimensions or quantities are only approximations and it is envisaged that the values higher/lower than the numerical values assigned to the parameters, dimensions or quantities fall within the scope of the invention, unless there is a statement in the specification specific to the contrary.

The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the embodiments as described herein.

The invention claimed is:

1. A system for recovering flash steam and condensate, said system comprising:

a flash steam recovery unit adapted for receiving a fluid containing flash steam and condensate through an inlet provided at an operative side of said flash steam recovery unit, said flash steam recovery unit further adapted for recovering flash steam from the condensate via a steam outlet provided at an operative top of said flash steam recovery unit; and a condensate recovery unit positioned at an operative bottom of said flash steam recovery unit and having an orientation for receiving the condensate by gravity from said flash steam recovery unit through a condensate inlet, said condensate recovery unit being operated by pressurized pumping means adapted for discharging the condensate through an outlet steam trapping unit operatively connected to a condensate outlet provided at the operative side of said condensate recovery unit, and discharging exhaust gas via an exhaust gas outlet provided at the operative top of said condensate recovery unit.

2. The system as claimed in claim 1, wherein said pressurized pumping means comprises a plurality of check valves for controlling the operation of said condensate recovery unit by means of a pressurized gas, wherein, in operation, when the condensate level in said condensate recovery unit reaches beyond a set level, the pressurized gas increases the pressure in said condensate recovery unit and said pressurized pumping means opens at least one of said plurality of valves at said condensate outlet, thereby discharging the condensate through said steam trapping unit while maintaining at least one of said plurality of valves at said condensate inlet closed, and when the condensate level in said condensate recovery unit reaches below a set level, pressurized exhaust gas is released via said exhaust gas outlet, thereby opening at least one of said plurality of valves at said condensate inlet to receive the condensate from said flash steam recovery unit in said condensate recovery unit while maintaining at least one of said plurality of valves at said condensate outlet closed.

3. The system as claimed in claim 1, wherein said pressurized gas is pressurized steam.

4. The system as claimed in claim 1, wherein an exhaust line is provided for operatively connecting said exhaust gas outlet to a location proximal to the operative top of said flash steam recovery unit for conveying pressurized exhaust steam to said flash steam recovery unit.

5. The system as claimed in claim 1, wherein said flash steam recovery unit further comprises an overflow trap located at said operative side of said flash steam recovery unit below said inlet for avoiding flooding of said flash steam recovery unit and maintaining a defined vapor space.

6. The system as claimed in claim 1, wherein a level indicator or a level-based means is provided to monitor the level of the fluid in said flash steam recovery unit.

7. The system as claimed in claim 1, wherein an additional condensate recovery unit is operatively connected to said flash steam recovery unit for preventing build-up of the fluid in said flash steam recovery unit due to failure of condensate recovery unit.

8. The system as claimed in claim 7, wherein said additional condensate recovery unit is operated by mechanical or level controlled means.

9. The system as claimed in claim 1, wherein a pH correction means operated by a pressure-driven mechanism is provided for correcting the pH of said condensate.

* * * * *